US009267261B2

(12) United States Patent
Royer et al.

(10) Patent No.: US 9,267,261 B2
(45) Date of Patent: Feb. 23, 2016

(54) HINGE ASSEMBLY AND CORRESPONDING ROAD DEVICE

(75) Inventors: Jean-Claude Royer, Lesmenils (FR); Vincent Rotharmel, Vandieres (FR); John Neil Pickavance, Bingham (GB)

(73) Assignee: SAINT-GOBAIN PAM, Nancy (FR)

( * ) Notice: Subject to any disclaimer, the term of this patent is extended or adjusted under 35 U.S.C. 154(b) by 304 days.

(21) Appl. No.: 13/144,919

(22) PCT Filed: Dec. 18, 2009

(86) PCT No.: PCT/FR2009/052630

§ 371 (c)(1), (2), (4) Date: Oct. 3, 2011

(87) PCT Pub. No.: WO2010/081953

PCT Pub. Date: Jul. 22, 2010

(65) Prior Publication Data

US 2012/0020728 A1 Jan. 26, 2012

(30) Foreign Application Priority Data

Jan. 15, 2009 (FR) ..... 09 50214

(51) Int. Cl.
*E02D 29/14* (2006.01)
*E05D 1/00* (2006.01)
(Continued)

(52) U.S. Cl.
CPC ..... *E02D 29/14* (2013.01); *E02D 29/1463* (2013.01); *E03F 5/06* (2013.01); *E05D 1/04* (2013.01); *E02D 29/1409* (2013.01); *E03F 2005/061* (2013.01); *Y10T 16/533* (2015.01)

(58) Field of Classification Search
CPC . E02D 29/14; E02D 29/1463; E02D 29/1409; E05D 1/06; E05D 1/04; E03F 5/06; E03F 2005/061; Y10T 16/533
USPC ..... 361/679.21; 52/20; 404/25; 16/355, 16/388, 363
See application file for complete search history.

(56) References Cited

U.S. PATENT DOCUMENTS 1,144,090 A * 6/1915 Anderson ..... 16/276
1,666,211 A * 4/1928 Kellogg ..... 296/92
(Continued)

FOREIGN PATENT DOCUMENTS

CN 1170069 A 1/1998
CN 1922366 A 2/2007
(Continued)

OTHER PUBLICATIONS

Chinese Office Action dated Apr. 17, 2013 for Chinese Application No. 200980157718.9, and translation thereof.
(Continued)

*Primary Examiner* — Elizabeth A Plummer
(74) *Attorney, Agent, or Firm* — Knobbe, Martens, Olson & Bear, LLP

(57) ABSTRACT

This hinge assembly comprises a lid with a covering web and a hinge adapted for enabling an angular movement of the lid between an open position and a closed position, the hinge including a first cam and a first counter-cam, the first cam and the first counter-cam cooperating over a first angular range. The hinge comprises an additional cam and an additional counter-cam cooperating over an additional angular range. The first angular range and the additional angular range overlap over an angular overlap range that amounts to at least 60° and over the entire range of which both the first cam and counter-cam and the additional cam and counter-cam cooperate simultaneously. The device can be used for road manholes.

13 Claims, 12 Drawing Sheets

(51) Int. Cl.
*E05D 1/04* (2006.01)
*E03F 5/06* (2006.01)

(56) References Cited

U.S. PATENT DOCUMENTS

| | | | | | |
|---|---|---|---|---|---|
| 1,923,481 | A * | 8/1933 | Ford | 220/484 |
| 2,302,661 | A * | 11/1942 | Benson | 16/267 |
| 3,648,328 | A * | 3/1972 | McCabe | 16/355 |
| 3,663,990 | A * | 5/1972 | Shane | 16/269 |
| 4,123,822 | A * | 11/1978 | Bentley | 16/355 |
| 4,230,381 | A * | 10/1980 | Rhoades | 312/295 |
| 4,508,469 | A * | 4/1985 | Dumortier | 404/25 |
| 5,017,039 | A * | 5/1991 | Spiess et al. | 404/25 |
| 5,054,723 | A * | 10/1991 | Arnold | 248/65 |
| 5,160,213 | A | 11/1992 | Spiess et al. | |
| 5,465,862 | A | 11/1995 | Devlin | |
| 6,459,887 | B2 * | 10/2002 | Okuda | 455/90.1 |
| 6,862,779 | B1 * | 3/2005 | Lu et al. | 16/340 |
| 7,013,530 | B2 * | 3/2006 | Lallemant | 16/297 |
| 7,448,512 | B2 * | 11/2008 | Hauer et al. | 404/25 |
| 7,627,930 | B2 * | 12/2009 | Duan et al. | 16/330 |
| 7,685,679 | B2 * | 3/2010 | Horng | 16/330 |
| 7,870,644 | B2 * | 1/2011 | Chang | 16/337 |
| 7,908,798 | B2 * | 3/2011 | Monneret | 52/20 |
| 8,006,439 | B2 * | 8/2011 | Hauer et al. | 52/19 |
| 8,206,058 | B2 * | 6/2012 | Vrondran et al. | 404/25 |
| 2004/0025299 | A1 * | 2/2004 | Higano et al. | 16/342 |
| 2005/0175409 | A1 * | 8/2005 | Hauer et al. | 404/25 |
| 2006/0112517 | A1 * | 6/2006 | Luo et al. | 16/330 |
| 2007/0022567 | A1 * | 2/2007 | Konja et al. | 16/221 |
| 2008/0141492 | A1 * | 6/2008 | Lin | 16/330 |
| 2009/0080972 | A1 * | 3/2009 | Hauer et al. | 404/25 |
| 2009/0100641 | A1 * | 4/2009 | Yang | 16/303 |
| 2009/0303674 | A1 * | 12/2009 | Tatsukami et al. | 361/679.21 |
| 2011/0150570 | A1 * | 6/2011 | Pickavance et al. | 404/25 |
| 2012/0213581 | A1 * | 8/2012 | Royer et al. | 404/25 |

FOREIGN PATENT DOCUMENTS

| | | | |
|---|---|---|---|
| EP | 0 856 611 | A | 8/1998 |
| EP | 0681066 | B1 | 8/1999 |
| EP | 1 013 833 | A | 6/2000 |
| FR | 2765255 | B1 | 10/1999 |
| JP | 3752041 | B2 | 3/2006 |

OTHER PUBLICATIONS

International Search Report and Written Opinion for International Application No. PCT/FR2009/052630, dated May 31, 2010.

* cited by examiner

HINGE ASSEMBLY AND CORRESPONDING ROAD DEVICE

RELATED APPLICATIONS

This application is a U.S. National Phase of International Application No.: PCT/FR2009/052630, filed Dec. 18, 2009, designating the U.S., and published in French as WO 2010/081953 on Jul. 22, 2010 which claims the benefit of French Patent Application No. 09 50214 filed Jan. 15, 2009.

FIELD OF THE INVENTION

The present invention relates to a hinge assembly, of the type comprising:

- a lid with a covering web delimiting a covering surface, said covering web being intended to cover an opening and extending along a covering plane;
- a hinge adapted for enabling an angular movement of the lid between an open position and a closed position,
- the hinge including a first frame cam and a first lid counter-cam, the first frame cam and the first lid counter-cam cooperating over a first angular range situated between the open and closed position,
- the hinge comprising an additional cam and an additional counter-cam cooperating over an additional angular range situated between the open and closed positions, the additional cam and the additional counter-cam having profiles different from the first frame cam and first lid counter-cam.

BACKGROUND OF THE INVENTION

Document EP 1 013 833 describes a hatch for accessing underground galleries and works provided with a frame and a lid, the lid being adapted to close an opening delimited by the frame.

The lid is hinged to the frame using a hinge that comprises a hinge pin 13 fixed to the frame and a groove 19 formed in the lid. The access hatch also has a heel 20 with a flat surface fixed to the frame and lugs 26 protruding from the lid. The lugs comprise a rounded cam surface that bears on the heel when the lid is opened (see column 5, lines 2 to 29 of EP 1 013 833).

The hinge pin 13 is fastened to the frame via tabs 12 welded to a plate, which in turn is fastened to the frame and the underground chamber by screws or bolts. Such a hinge is, however, fragile because under the force of the lid during repeated opening and closing operations, the screws or bolts for fastening the plate can loosen and cause poor positioning of the plate, and therefore of the hinge pin, thereby causing jamming and poor closing of the lid. Moreover, under the force of the lid during hinging, the tabs 12 supporting the hinge pin can fold, or even separate from the plate in the event of weld breaks, thereby again leading to a defective hinging.

Furthermore, the hinge in this document is costly and complicated to produce due to the many shaping and welding steps needed to develop the plate having the hinge pin.

Document FR 2 765 255 describes an access hatch comprising a frame and a plurality of lids. The lids can be moved from a closed position to an open position and are kept in a completely open position owing to a support piece cooperating with one edge of the lid.

This device does not allow positive guiding of the lid between its closed position and its open position and is also difficult to manufacture due to the large number of components.

SUMMARY OF THE INVENTION

The invention aims to solve at least one of these problems, and to design a hinge assembly that is resistant and easy to manufacture.

To that end, the invention relates to a hinge assembly characterized in that the first angular range and the additional angular range overlap over an angular overlap range that amounts to at least 60° and over the entire range of which both the first frame cam and first lid counter-cam and the additional cam and counter-cam cooperate simultaneously.

According to specific embodiments, the invention includes one or more of the following features:

- the angular overlap range amounts to at least one of the following values: 65°, 70°, 80, 85°.
- the angular overlap range and the first angular range coincide.
- the first frame cam has a partial cylinder-shaped cam surface with an arc-shaped section, in particular a circular arc.
- the first lid counter-cam is, when the lid is in its closed position, situated, in particular completely, inside the projection of the covering surface.
- the additional cam and counter-cam include a second frame cam and a second lid counter-cam, the additional angular range comprises a second angular range, the second frame cam and the second lid counter-cam cooperating over this second angular range situated between the open and closed positions.
- the second angular range is delimited by the closed position.
- the second lid counter-cam is situated over one end of a first projection extending perpendicular to the covering plane and the second frame cam has a first partial cam surface.
- the second frame cam has a second partial cam surface that is inclined relative to the first partial cam surface.
- the additional cam and counter-cam have a third cam and a third counter-cam cooperating over a third angular range situated completely outside the second angular range.
- the third cam and the third counter-cam are an axis and a recess with a circular arc-shaped section.
- the assembly includes support means adapted to support the lid relative to a frame in the closed position in a direction perpendicular to the covering plane, in particular this support means comprising the end of the first projection and the first partial cam surface.
- the assembly has a retaining means adapted to translationally lock the lid relative to the first frame cam along the cover plane when the lid is in the closed position, this retaining means comprising a second projection fixed relative to the first frame cam and which cooperates with a recess formed in the lid when the latter is in the closed position.
- the assembly comprises a locking means defining a locked opening position in which the lid is prevented from tilting towards the closed position and allowing the lid to move between this locked opening position and an unlocked open position of the lid.
- the locking means comprises a stop surface adjacent to the first frame cam and a stop surface situated opposite the first frame cam.
- at least one of the counter-cams is fastened to the lid, and in particular at least one counter-cam is integral with the lid.

The invention also relates to a road device of the type comprising:

a frame delimiting an opening, characterized in that it includes an assembly as defined above, in that the lid is adapted to cover the opening of the frame and in that the or each cam is fastened to the frame.

According to specific embodiments, the road device can include one or more of the following features:

the or each cam is made in a single piece with the frame.

the or each cam is a piece attached to the frame.

BRIEF DESCRIPTION OF THE DRAWINGS

The invention will be better understood in light of the following description, provided solely as an example and done in reference to the appended drawings, in which.

DETAILED DESCRIPTION OF THE EMBODIMENTS

Figure 1:
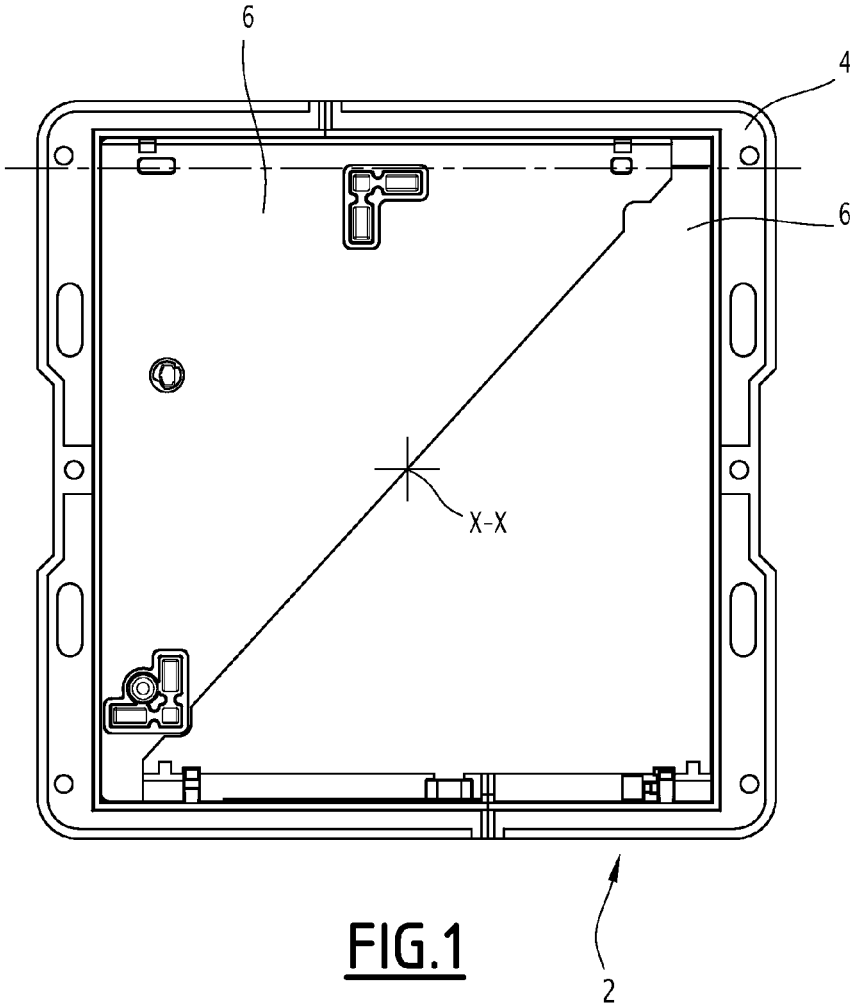
FIG. 1 is a planar view of a road device according to the invention, the device being closed.

FIG. 1 shows a road device, such as an access cover, designated by general reference 2. The road device 2 is shown in a planar top view. The road device 2 includes a polygonal frame 4, in particular square or rectangular, and at least one lid, in this case two lids 6.

The frame 4 delimits an access opening 10, for example to underground telecommunications installations. The frame 4 defines an outer side E and an inner side I.

Figure 2:
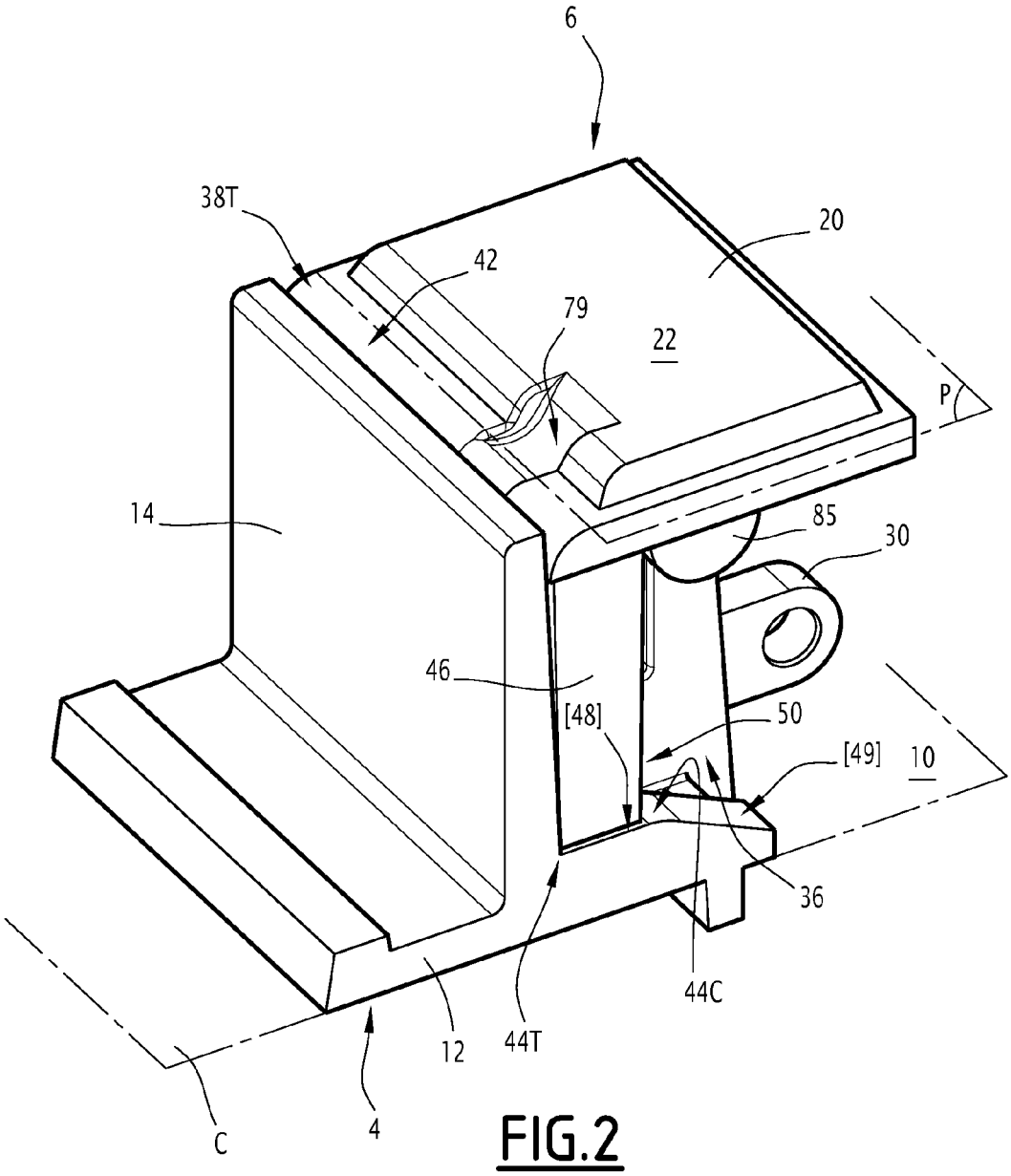
FIG. 2 is a perspective view of a hinge assembly of the road device according to FIG. 1, seen from outside and above, and provided with an insert.

The frame 4 defines a frame plane C-C parallel to the plane of FIG. 1, in which the opening 10 extends (FIG. 2). The frame 4 has a base 12 extending parallel to the frame plane C-C and a wall 14 extending substantially perpendicularly relative to the frame plane C-C. The wall 14 thereby delimits a substantially polygonal surface in this case having a square cross-section.

The frame defines a central axis X-X, extending perpendicular to the frame plane C-C. The expressions "radially" and "circumferentially" hereafter refer to the central axis X-X.

The lid 6 has a covering web 20 adapted for at least partially covering the opening 10 and extending along a covering plane P-P. The covering web 20 has an outer covering surface 22 and an inner covering surface 24.

Figure 4:
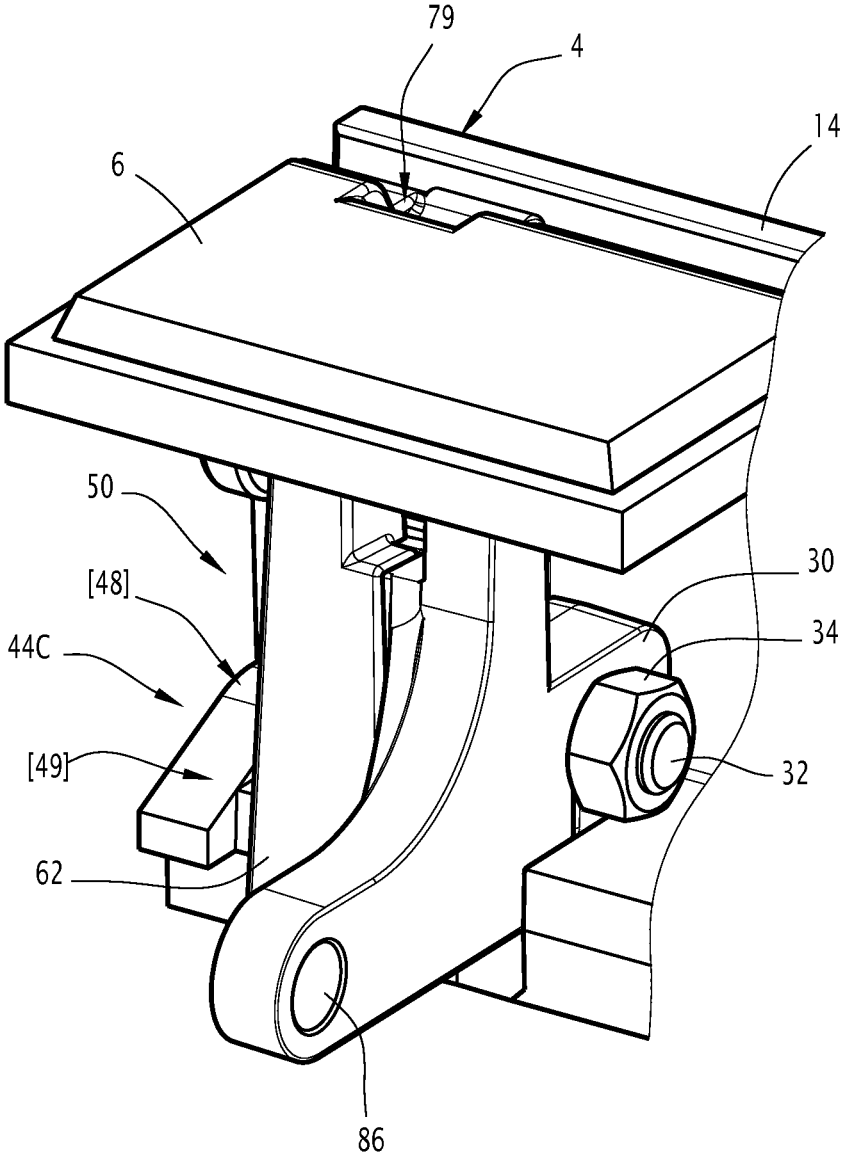
Figure 5:
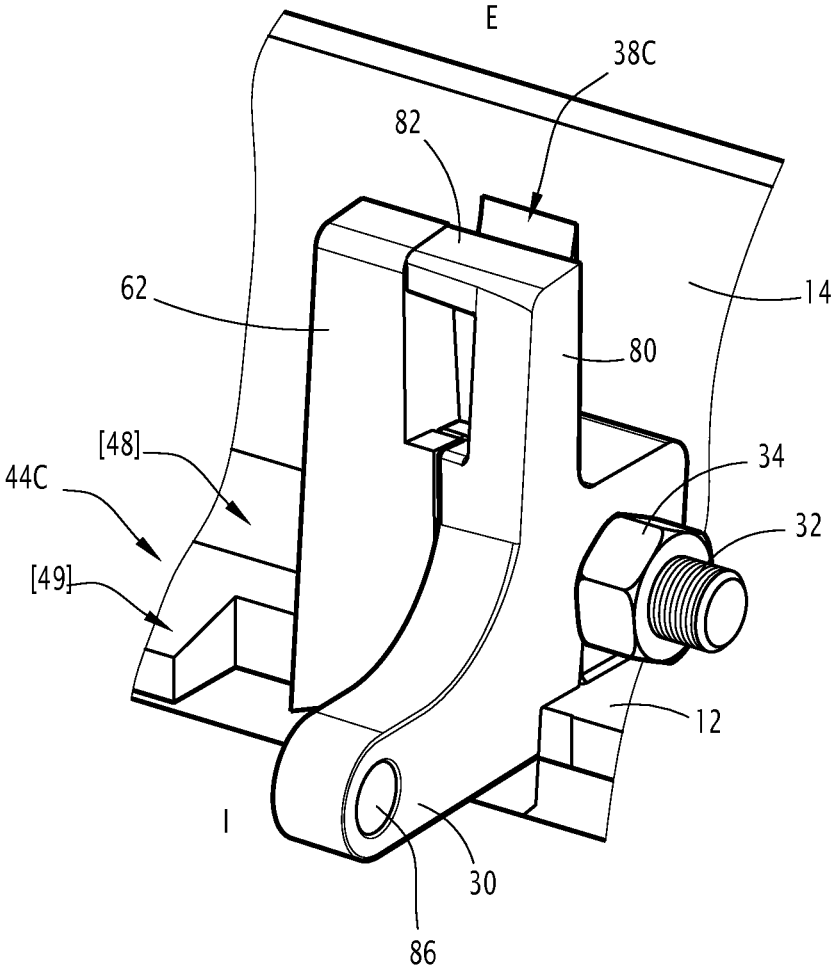
FIG. 5 is a view of the part of the frame of the hinge assembly, and of an insert, the lid being omitted.
Figure 6:
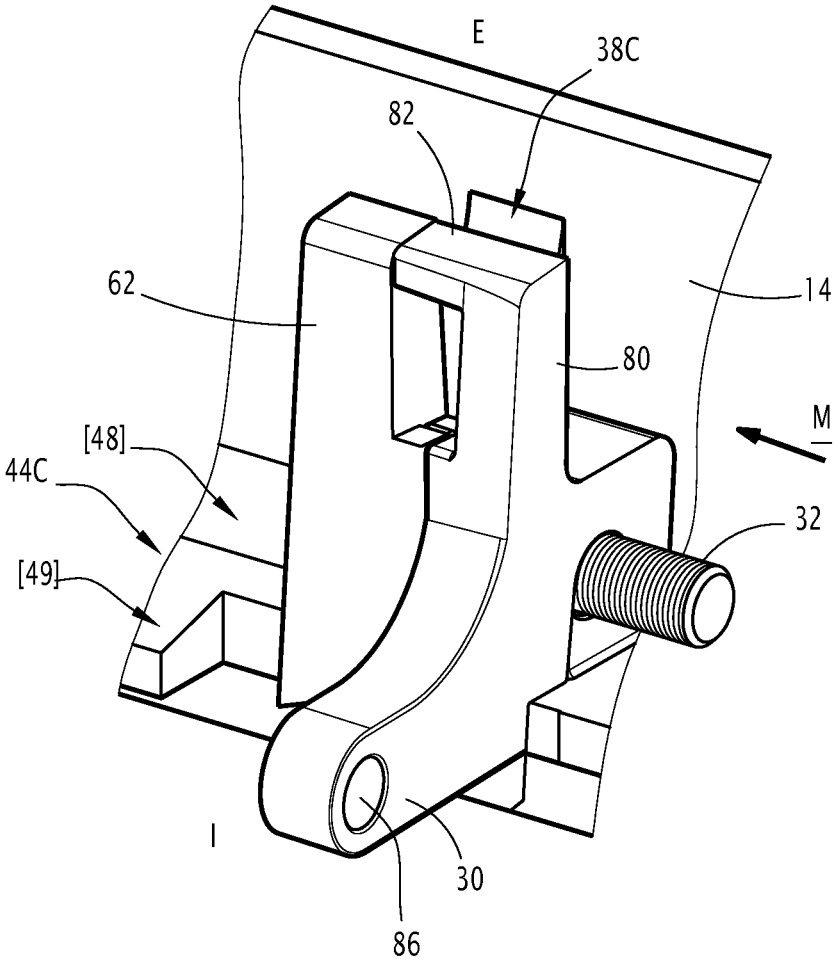
FIG. 6 is a view identical to that of FIG. 5, the nut being omitted.

The access cover 2 also has an insert 30, a screw 32 and a nut 34 (c.f. FIG. 4).

The access cover 2 has at least one hinge 36 adapted for allowing angular movement of the lid 6 relative to the frame 4 between an open position and a closed position.

Figure 14:
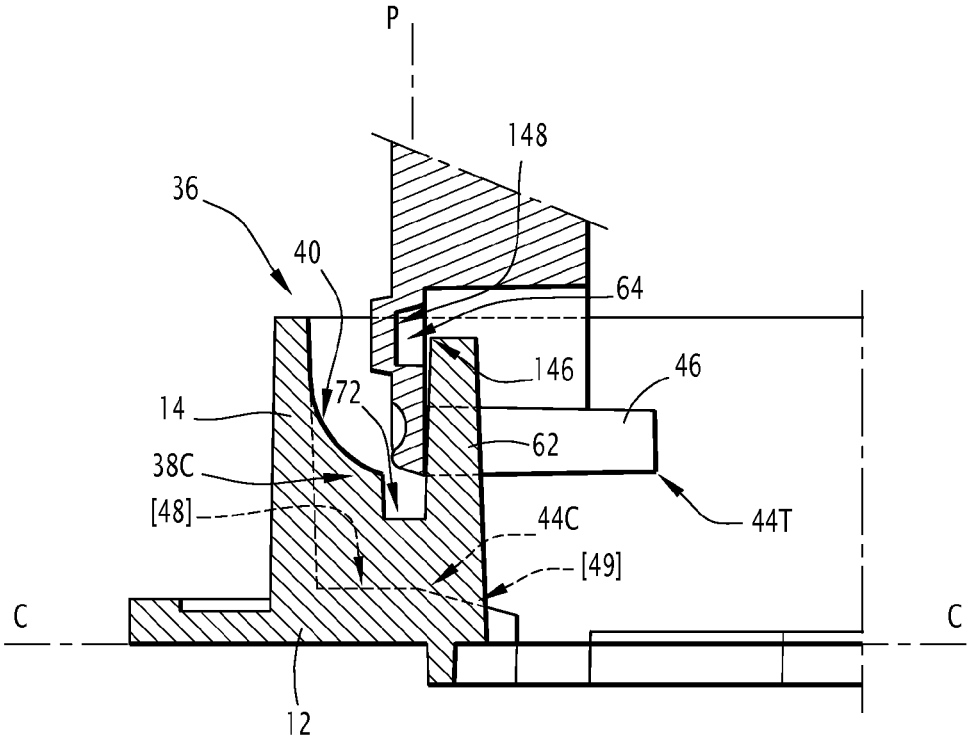

The closed position is shown in FIGS. 1 to 4 and 11. In the closed position, the lid 6 at least partially covers the opening 10, and the plane P-P of the covering web 20 extends parallel to the frame plane C-C. In the open position, the covering plane P-P of the covering web 20 extends substantially perpendicularly relative to the frame plane C-C. In the open position, the lid can move between two open positions, i.e. a freed open position (cf. FIG. 14) and a locked open position. In the freed open position, the lid 6 can move between this position and the closed position. In the locked open position, the lid 6 is prevented from tilting towards its closed position. Also in this locked open position, the lid can tilt into an extreme open position (cf. FIG. 15), in which the covering web 20 is moved by more than 90° relative to its closed position, and is for example tilted by 110°.

Figure 3:
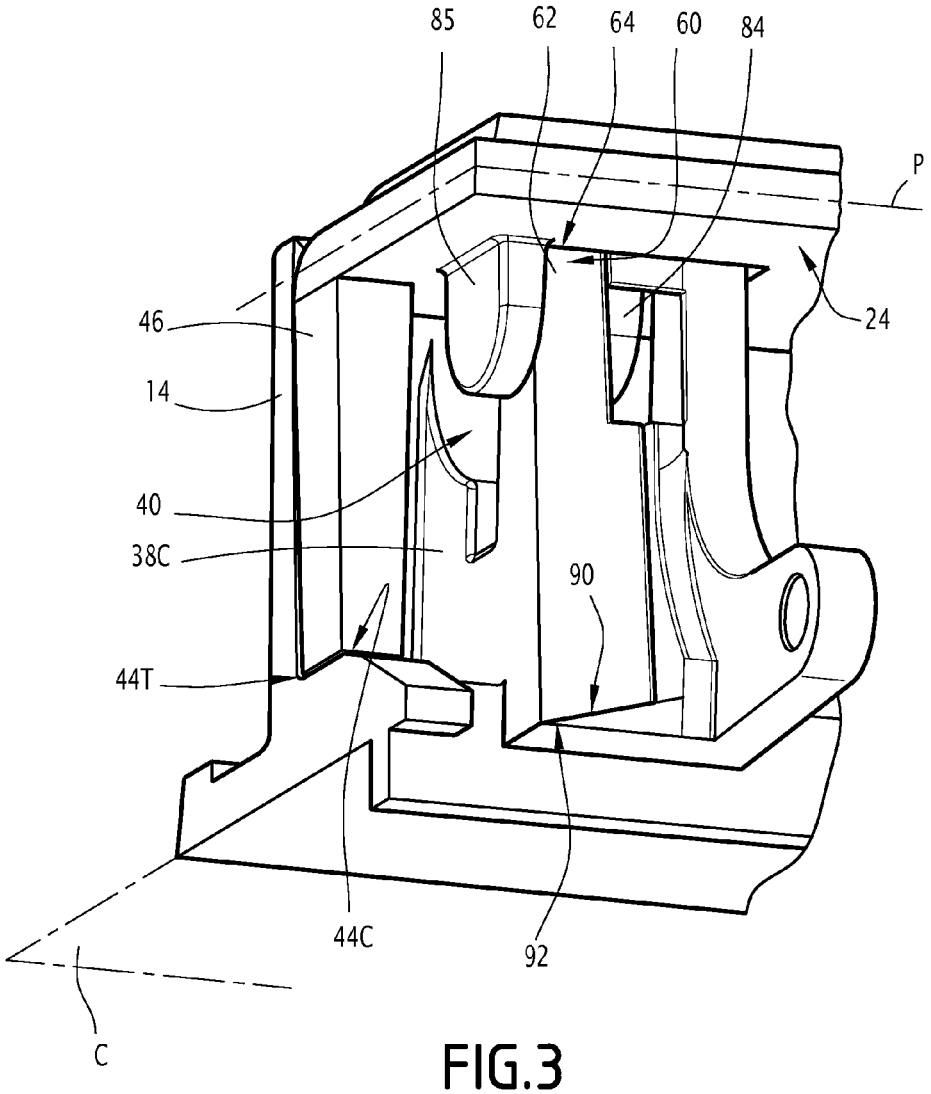
FIGS. 3 and 4 are perspective views of the hinge assembly of FIG. 2, seen from the inside, from the bottom and top, respectively.

In reference to FIGS. 2 to 4, the hinge 36 comprises a first frame cam 38C, as well as a first lid counter-cam 38T. The first frame cam 38C has a cam surface 40 in the shape of a partial cylinder with a circular arc-shaped section. This cam surface 40 is concave and is continuously attached to an inner surface of the wall 14. The first frame cam 38C is arranged completely inside the volume delimited by the wall 14, and protrudes from said wall 14 with a component radially oriented towards the axis X-X.

The cam surface 40 leads to a low wear of the hinge during use, and facilitates docking of the lid counter-cam 38T when closing begins.

The first lid counter-cam 38T is arranged adjacent to the covering web 20 and forms an edge of the lid 6. The first lid counter-cam 38T has a counter-cam surface 42 that is a partial cylinder with an arc-shaped profile, convex. This counter-cam surface 42 for example forms an angular sector of about 5° to 15°. The first lid counter-cam 38T is continuously attached to the outer surface 22 of the covering web 20.

The first frame cam 38C and the first lid counter-cam 38T are adapted to cooperate over a first angular range $\alpha$ of the covering web 20. This first angular range $\alpha$ extends from the open position, possibly with play close to 5°, towards the closed position, and is between about 60° and 90°. In all of this first angular range $\alpha$, the two cam 40 and counter-cam 42 surfaces are pressed against each other.

Figure 12:
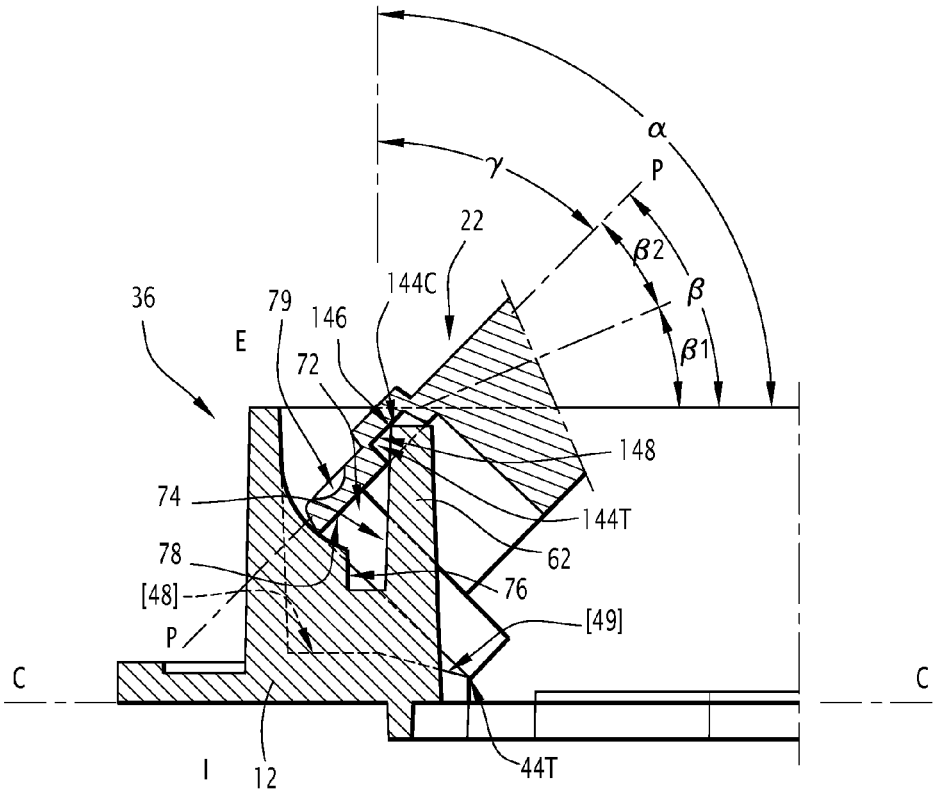
Figure 13:
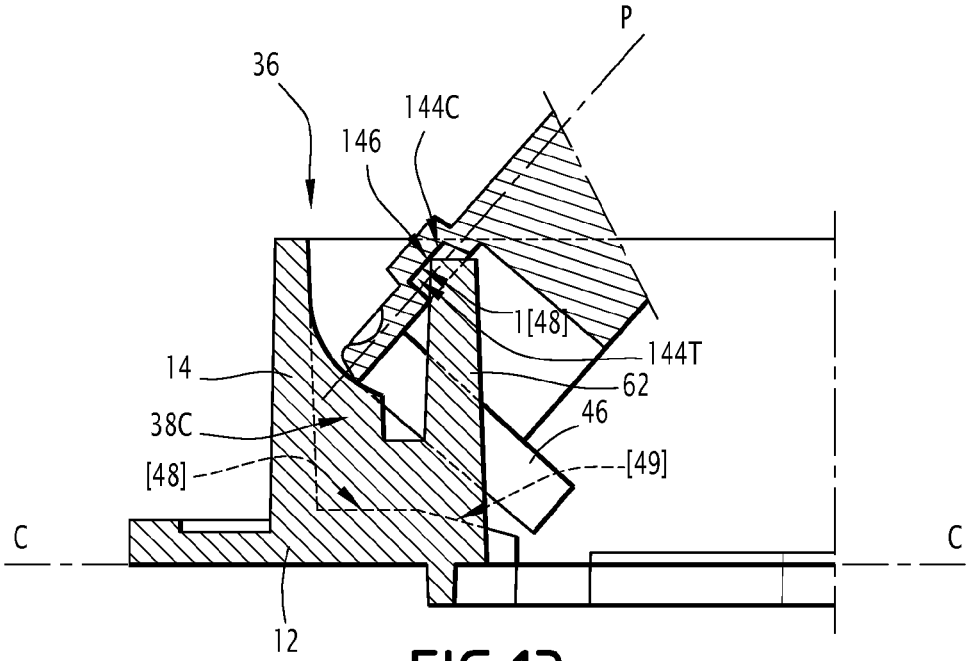

Preferably, as shown in FIG. 12, this first angular range $\alpha$ is delimited on the one hand by the open position of the lid 6 and on the other hand by the closed position of the lid 6 relative to the frame 4, thereby forming an angle of about 90°, possibly with play of about 5°.

As shown in FIG. 1, when the lid 6 is in its closed position, the first lid counter-cam 38T is situated completely inside the volume delimited by the wall 14.

The hinge 36 also has a second frame cam 44C as well as a second lid counter-cam 44T. The second frame cam 44C is arranged on the base 12 of the frame and extends inside the volume defined by the wall 14. The second frame cam 44C and lid counter-cam 44T are adapted for cooperating exclusively over a second angular range $\beta$ of the lid 6 relative to the frame 4 that corresponds to positions of the covering web 20 situated between the open and closed positions. More precisely, the second angular range $\beta$ is delimited on the one hand by the closed position of the web 20 and a first inclined intermediate position (see FIG. 12). This first intermediate position corresponds to an incline of the web 20 preferably between 40° and 50° relative to the closed position, and in particular an incline of 45° as shown in FIG. 12. The angular range β thus has a range between 40° and 50° from the closed position.

The angular range β and the angular range α overlap over at least 10°.

The lid 6 is provided with a projection 46 extending perpendicular to the covering plane P-P. The second lid counter-cam 44T has a counter-cam surface formed by a corner of this projection 46.

The second frame cam 44C has a first partial cam surface 48, as well as a second partial cam surface 49. The first partial cam surface 48 is substantially planar and extends parallel to the frame plane C-C. The second partial cam surface 49 is also planar and inclined relative to the first partial cam surface 48. The first partial cam surface 48 cooperates with the second lid counter-cam 44T exclusively over a first partial angular range β1 extending from the closed position to a second intermediate position, which is different from the first intermediate position. The first partial angular range β1 corresponds to an angle between the plane P-P and the plane C-C between about 0° and 15°. The second partial cam surface 49 cooperates with the second lid counter-cam 44T exclusively over a second partial angular range β2 separate from the first partial angular range β1, the partial angular ranges β1 and β2 together constituting the second angular range β. This partial angular range β2 is therefore between 15° and 40° to 50°, and more particularly between 15° and 45° as shown in FIG. 12.

Thus, between the closed position (FIG. 11) and the second intermediate position, i.e. over the first partial angular range β1, simultaneously, on the one hand the first partial cam surface 48 cooperates with the counter-cam surface of the second lid counter-cam 44T, and on the other hand the first frame cam 38C cooperates with the counter-cam surface 42 of the first lid counter-cam 38T. The first lid counter-cam 38T is, when the lid is in its closed position, situated inside a projection of the covering surface 23. Between the second intermediate position and the first intermediate position (FIG. 12), i.e. over the second partial angular range β2, the counter-cam surface of the second lid counter-cam 44T is pressed on the second partial cam surface 49 and, at the same time, the counter-cam surface 42 of the first lid counter-cam 38T is applied on the cam surface 40 of the first frame cam 38C. The incline of the second partial cam surface 49 facilitates berthing of that surface by the second lid counter-cam 44T during closing of the lid.

The hinge 36 also has a third frame cam 144C and a third lid counter-cam 144T. This third frame cam 144C and lid counter-cam 144T cooperate exclusively over a third angular range γ of the lid 6 relative to the frame 4. This third angular range γ is situated completely outside the second angular range β. It is delimited, on the one hand by a first inclined intermediate position that limits the second angular range β and on the other hand the open lid position, possibly with play close to several degrees. The angular range γ is consequently between about 40° and 50°, and more particularly extends over 45° as shown in FIG. 12. Thus, the angular range γ and the angular range α overlap over at least 40°. In the described example, the angular ranges α and γ overlap over about 45°.

In this case, the third frame cam 144C is formed by a cam surface 146 arranged on the projection 62 and the third lid counter-cam 144T is formed by a counter-cam surface 148 formed by the lower surface of the lid, and particularly by the recess 64 (see below).

According to the invention, the lid and the frame cooperate simultaneously with two cam and counter-cam pairs over a large angular range, which is preferably at least 60° and which in this case amounts to 90°, possibly with the aforementioned close play.

The cover 2 also has a support means 50 adapted for supporting the lid 6 relative to the frame 4 in the closed position of the lid and in a direction perpendicular to the frame C-C. Advantageously, the support means 50 comprises the first partial cam surface 48 and the free end of the projection 46. The free end of the projection 46 is pressed on the first partial cam surface 48 in the closed state of the lid 6. The contact between the free end of the projection 46 and the first partial cam surface 48 is a surface contact. Preferably, at least on the hinge side, the support means 50 is formed by the first partial cam surface 48 and by the free end of the projection 46. The bearing between the lid and the frame on the side opposite the hinge is done by a projection similar to the projection 46 under the lid, which bears on a horizontal surface similar to the surface 48 of the frame.

To that end, the projection 46 has a planar end surface 52 parallel to the covering plane P-P, thereby guaranteeing the bearing stability of the lid on the frame.

Figure 11:
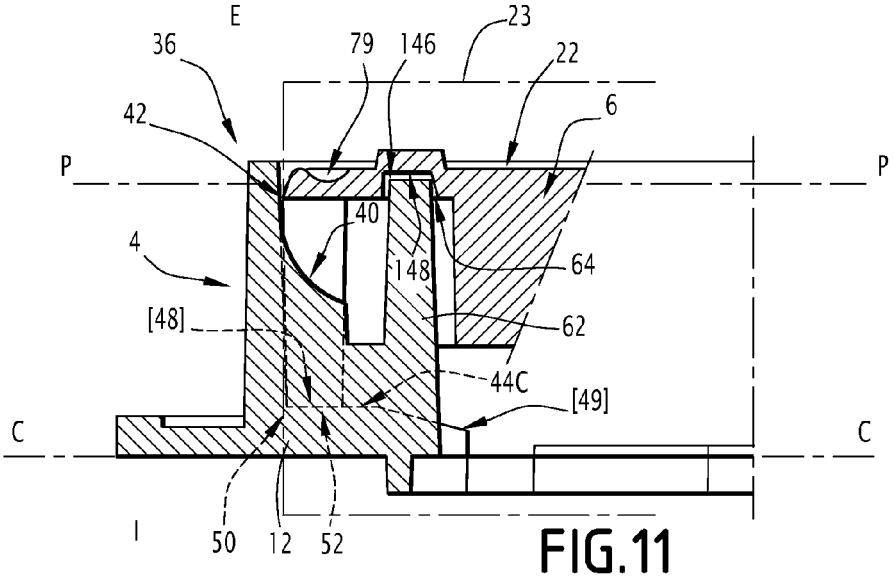
FIGS. 11 to 15 are side and cross-sectional views of the hinge assembly in different configurations, between the closed and open position.

The road device 2 also has a retaining means 60 adapted to lock the lid 6 relative to the frame 4 and in translation along the frame plane C-C when the lid 6 is in the closed position (see FIGS. 3 and 11).

This retaining means 60 comprises the projection 62 integral with the frame 4, as well as a recess 64 formed in the inner covering surface 24 of the lid 6. In the closed position of the lid 6, the projection 62 is engaged in the recess 64 and limits the movement of the lid 6 along plane P-P. In particular, this retaining means 60 limits the movement of the lid 6 relative to the frame in a translational direction tending to move the lid 6 away from the wall 14 associated with the hinge and in particular opposes contact of the lid with another lid or with the side of the frame 4 situated opposite the hinge 36. This retaining means 60 is particularly important in the case where the lid 6 is connected to the frame 4 using a jack stressing the lid 6 in a direction moving away from the wall 14 associated with the hinge 36.

The cover 2 also has a locking means 70 adapted for defining the opening position of the lid 6 relative to the frame 4. This locking means 70 is adapted to allow the lid 6 to move relative to the frame 4 between the freed open position (FIG. 14) in which the lid 6 can be moved from its open position to its closed position, and a locked open position in which the lid 6 is prevented from tilting towards the closed position.

To that end, the locking means 70 comprises a notch 72 extending between the frame cam 38C and the projection 62 (see FIGS. 11 and 12). The notch 72 delimits a stop surface 74 adjacent to the projection 62 and a stop surface 76 adjacent to the first frame cam 38C. The locking means 70 has a corresponding stop surface 78 (see FIG. 12) arranged on the lid 6. When the lid 6 is located in the notch 72 and when it is moved towards its closed position, the stop surface 78 is pressed against the stop surface 74, preventing the lid from tilting.

Figure 15:
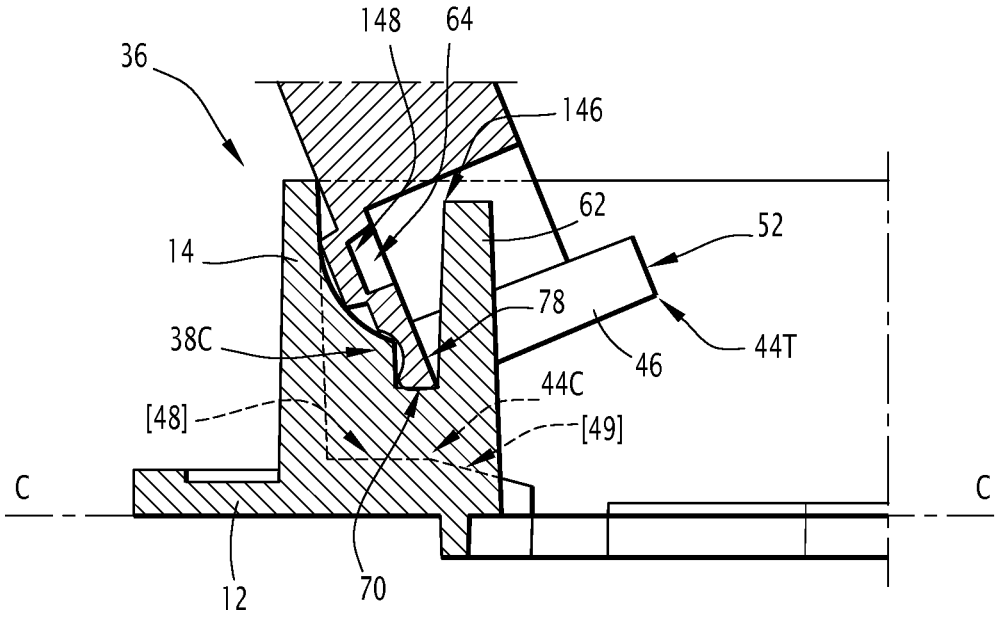

The outer surface 22 of the lid 6 is also provided with a hollow 79 adapted for at least partially receiving the stop surface 76 and thereby allowing the lid 6 to reach the extreme open position in which the lid makes an angle of about 110° relative to its closed position (FIG. 15).

Advantageously, the frame 4 is not provided with a backdraft in the direction extending perpendicular to the frame plane C-C. Likewise, the lid 6 does not have a backdraft in a direction extending perpendicular to the covering plane P-P.

The frame 4 is made from cast iron. Advantageously, at least one frame cam 38C, 44C, 144C and preferably all of the frame cams, is or are made in a single piece, and are in particular integral with the frame 4.

The lid 6 is made from cast iron. Advantageously, at least one counter-cam 38T, 44T, 144T and preferably all of the counter-cams, is or are made in a single piece, and are in particular integral with the lid 6.

The lid 6 of the road device described above can be detached from the frame 4 either from its closed position, by translating the lid in a direction perpendicular to its plane P-P, or from its open position, by translating the lid in a direction substantially parallel to its plane P-P. The assembly of the lid 6 on the frame 4 can therefore also be done with the lid 6 in the horizontal or vertical position.

Figure 9:
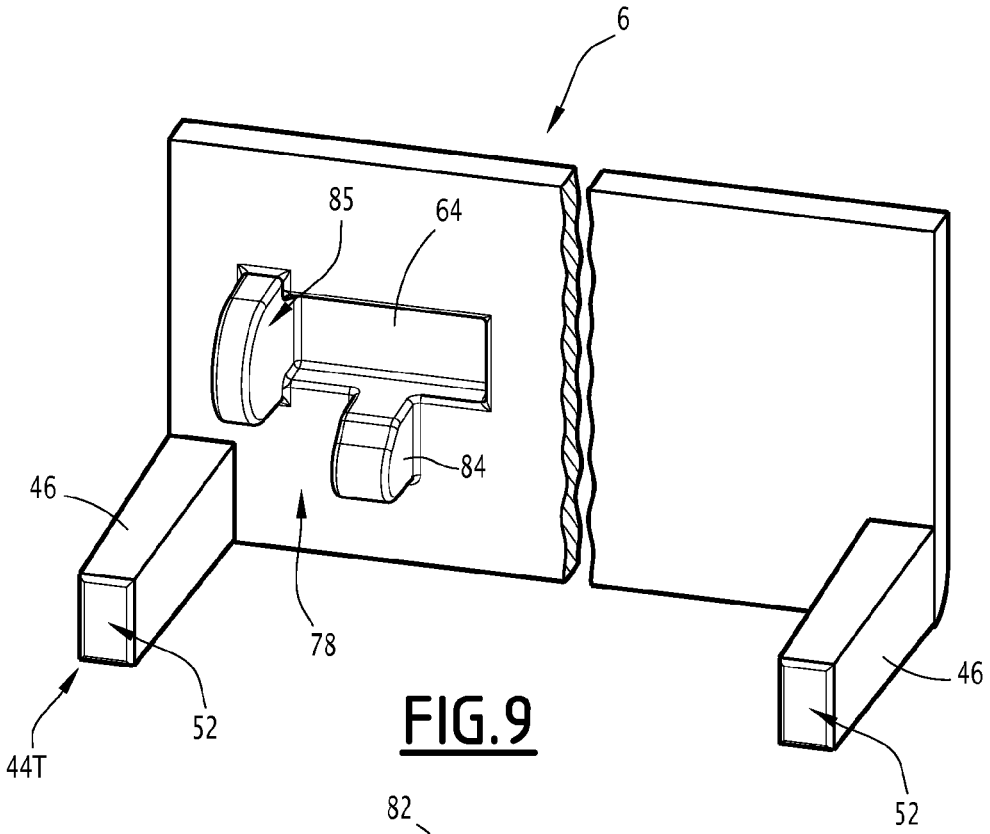
FIG. 9 is a perspective view of the inner side of part of the lid.

The frame 4 and the lid 6 can advantageously be used in connection with a jack assisting with raising (not shown) that is adapted for pushing the lid 6 towards its open position. The insert 30 is provided so as to be able to fasten this cylinder to the frame 4. The insert 30 is fastened to the frame 4 on the side with the projection 62 and the first frame cam 38C (cf. FIGS. 3 to 6). The insert 30 has a projection 80 extending parallel to the projection 62. The projection 80 has a valve bridge 82 pressed against the projection 62 in the assembled state. This valve bridge 82 forms a retaining surface for retaining the lid 6 relative to the frame during opening and closing phases of the lid, when the jack tends to push the lid towards the side of the frame situated opposite the hinge. To that end, the lid has an appendage 84 (see FIG. 9) pressed against the valve bridge 82 so as to limit the movement of the lid 6 towards the side of the frame 4 situated opposite the hinge 36. Furthermore, given that the appendage 84 is placed between the projections 62 and 80 during the opening and closing movements of the lid 6, it also ensures guiding of the lid 6 during rotation thereof, in particular limiting the movements of the lid 6 in a direction parallel to the wall 14 associated with the hinge 36. Moreover, also to limit this type of movement of the lid 6 when the latter is in the closed position, in which position the appendage 84 is not situated between the projections 62 and 80, it is advantageous to provide the lid 6 with an additional appendage 85. This additional appendage 85 is offset relative to the appendage 84 and is adapted, in the closed position, for abutting against the face of the projection 62 situated opposite the insert 30.

The insert 30 is also provided with a fastening orifice 86 serving for fastening of the jack.

Figure 10:
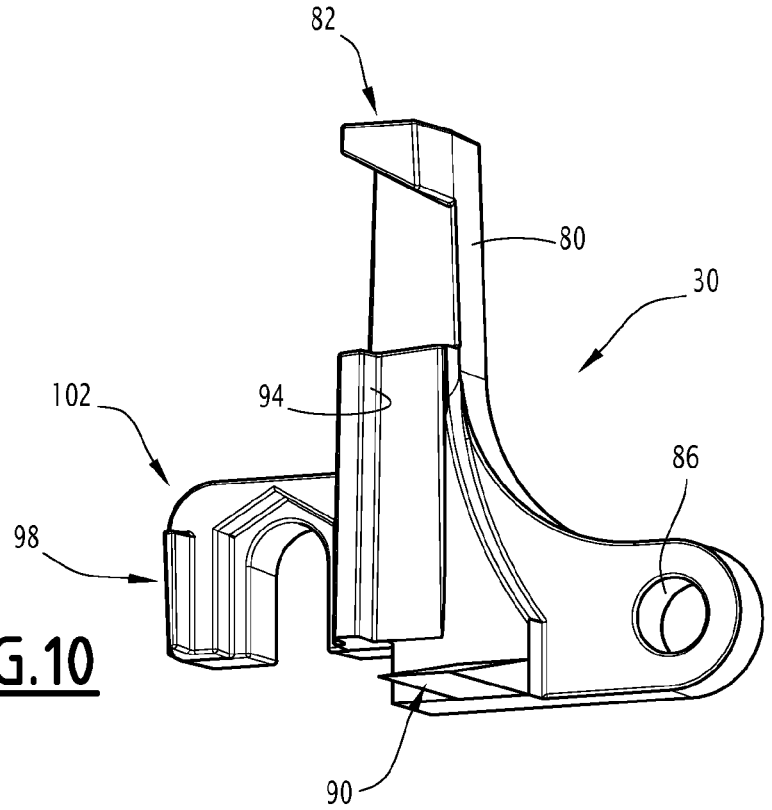
FIG. 10 is a perspective view of the insert.

The insert 30 also has a retaining surface 90 (see FIG. 10) adapted to retain the insert 30 relative to the frame 4 in a direction perpendicular relative to the frame plane C-C oriented towards the outside. The retaining surface 90 cooperates with a retaining surface 92 integral with the frame 4. The insert 30 also has a retaining surface 94 adapted to retain the insert 30 against a movement towards the center of the frame and cooperating with a complementary retaining surface 96 integral with the frame (see FIG. 8).

Additional and complementary retaining surfaces 98, 100 and 102, 104 are arranged on the insert 30 and the frame 4 and serve to retain the insert 30 relative to the frame 4 in the direction extending along the wall 14 and against the wall 14. The insert 30 can be placed exclusively in a single rectilinear placement direction M extending parallel to the frame plane C-C and along the wall 14 (cf. FIG. 6).

Figure 7:
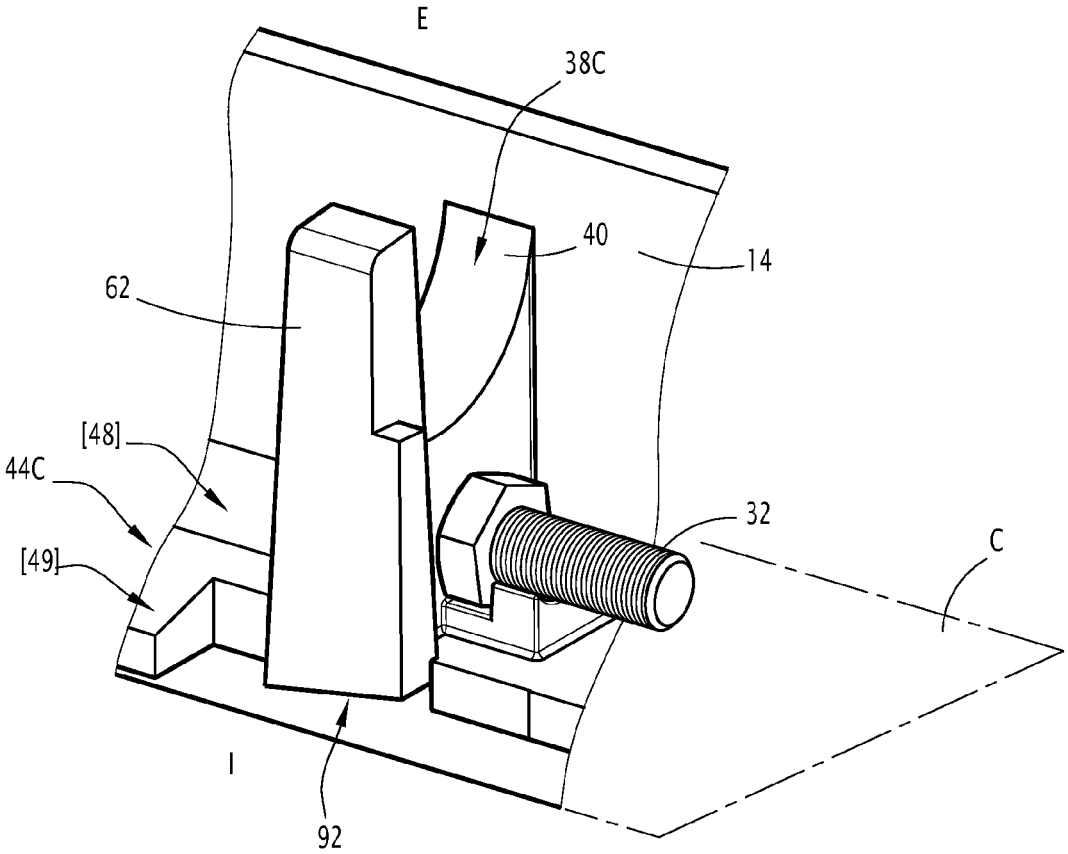
FIG. 7 is a view identical to that of FIG. 6, the insert being omitted.
Figure 8:
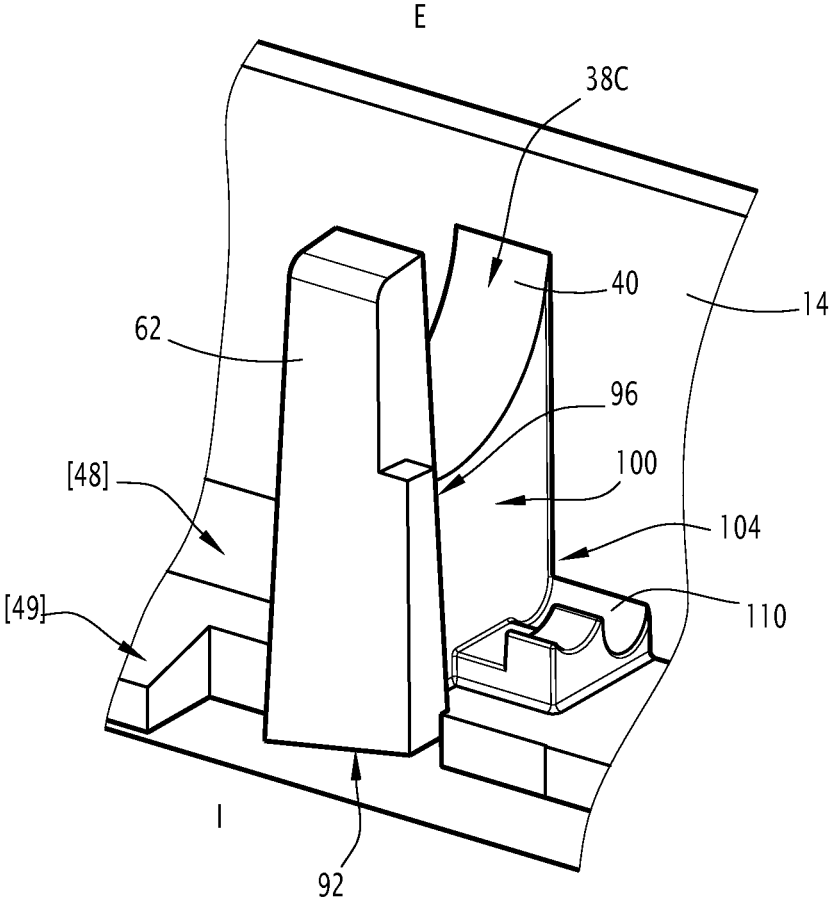
FIG. 8 is a view identical to that of FIG. 7, the screw being omitted.

The frame has a screw housing 110 receiving the screw 32 (FIGS. 7 and 8). When the screw 32 is located in the screw housing 110 and the nut 34 is in place, the insert 30 is retained by the screw 32, the nut 34 and the housing 110 against a release of the frame 4 in a direction opposite the direction M.

In one alternative not shown, the insert 30 is made in a single piece with the projection 62, the assembly then being integral with the frame or attached on the frame using any suitable fastening means.

According to another alternative not shown, the third frame cam and the third lid counter-cam have pivot pin and a recess with a circular arc-shaped section that are pressed against each other over the third angular range $\gamma$.

Other general features of the invention are:

the first angular range $\alpha$ is delimited by the open position and extends towards the closed position.

the first lid counter-cam 38T has a partial cylindrical surface with an arc-shaped profile, in particular extending over a circular arc from 5° to 15°.

the first lid counter-cam 38T is arranged adjacent to the covering web 20.

What is claimed is:

1. A hinge assembly comprising:

a lid with a covering web delimiting a covering surface, said covering web being adapted to cover an opening and extending along a covering plane;

a hinge adapted for enabling an angular movement of the lid between an open position and a closed position, the hinge comprising a first frame cam and a first lid counter-cam, the first frame cam and the first lid counter-cam cooperating over a first angular range situated between the open and closed position, the first frame cam and the first lid counter-cam shaped so as to define a first angular movement of the lid over the first angular range, and the first lid counter cam arranged adjacent to the covering web to form an edge of the lid;

the hinge comprising an additional cam and an additional counter-cam cooperating over an additional angular range situated between the open and closed positions, the additional cam and the additional counter-cam having profiles different from the first frame cam and the first lid counter-cam, the additional cam and the additional counter-cam shaped so as to define an additional angular movement of the lid over the additional angular range, wherein the additional cam and the additional counter-cam comprise a second frame cam and a second lid counter-cam, in that the additional angular range comprises a second angular range, the second frame cam and the second lid counter-cam cooperating over the second angular range situated between the open and closed positions;

wherein the first angular range and the additional angular range overlap over an angular overlap range that amounts to at least 60° and whereby over the entire angular overlap range both the first frame cam and the first lid counter-cam and the additional cam and the additional counter-cam cooperate simultaneously;

wherein the additional cam and the counter-cam further comprise a third frame cam and a third lid counter-cam cooperating over a third angular range situated completely outside the second angular range, wherein the third frame cam and the third lid counter-cam cooperate exclusively over the third angular range situated completely outside the second angular range, and wherein the third angular range situated completely outside the second angular range extends over between 40° and 50°; and wherein the first lid counter-cam is, when the lid is in its closed position, situated inside a projection of the covering surface.

2. The hinge assembly according to claim 1, wherein the angular overlap range is at least 65°.

3. The hinge assembly according to claim 1, wherein the angular overlap range and the first angular range coincide.

4. The hinge assembly according to claim 1, wherein the first frame cam has a partial cylinder-shaped cam surface with an arc-shaped section.

5. The hinge assembly according to claim 1, wherein the second angular range is delimited by the closed position.

6. The hinge assembly according to claim 1, wherein the second lid counter-cam is situated at one end of a first projection extending perpendicular to the covering plane and the second frame cam has a first partial cam surface.

7. The hinge assembly according to claim 6, wherein the second frame cam has a second partial cam surface that is inclined relative to the first partial cam surface.

8. The hinge assembly according to claim 6, wherein the assembly comprises a support means to support the lid relative to a frame in the closed position in a direction perpendicular to the covering plane, in particular this support comprising the end of the first projection and the first partial cam surface.

9. The hinge assembly according to claim 1, wherein the assembly comprises a retaining means adapted to translationally lock the lid relative to the first frame cam along the cover plane when the lid is in the closed position, this retainer comprising a second projection fixed relative to the first frame cam and which cooperates with a recess formed in the lid when the latter is in the closed position.

10. The hinge assembly according to claim 1, wherein the assembly comprises a locking means defining a locked opening position for the lid, in which the lid is prevented from tilting towards the closed position and allowing the lid to move between this locked opening position and an unlocked open position of the lid.

11. The hinge assembly according to claim 10, wherein the lock comprises a stop surface adjacent to the first frame cam and a stop surface situated opposite the first frame cam.

12. The hinge assembly according to claim 1, wherein at least one of the first or additional counter-cams is fastened to the lid.

13. The hinge assembly according to claim 1, wherein the first frame cam has a partial cylinder-shaped cam surface with the circular arc-shaped section.

* * * * *